United States Patent [19]

Saito et al.

[11] Patent Number: 4,613,113

[45] Date of Patent: Sep. 23, 1986

[54] APPARATUS FOR BLOWING POWDERY REFINING AGENT INTO REFINING VESSEL

[75] Inventors: Sadayuki Saito; Shunji Hamada; Tadaaki Iwamura; Ryoji Takabe, all of Chiba, Japan

[73] Assignee: Kawasaki Steel Corporation, Kobe, Japan

[21] Appl. No.: 703,461

[22] Filed: Feb. 21, 1985

Related U.S. Application Data

[63] Continuation of Ser. No. 563,448, Dec. 20, 1983, abandoned.

[30] Foreign Application Priority Data

Dec. 22, 1982 [JP] Japan ..... 57-225649

[51] Int. Cl.[4] ..... C21B 5/02

[52] U.S. Cl. ..... 266/83; 266/216; 266/267

[58] Field of Search ..... 266/81-83, 266/216, 217, 85, 267, 268; 75/60; 406/124, 146

[56] References Cited

U.S. PATENT DOCUMENTS

| | | | |
|---|---|---|---|
| 3,689,045 | 9/1972 | Coulter et al. | 266/83 |
| 4,136,857 | 1/1979 | Kolb | 266/83 |
| 4,286,774 | 9/1981 | Benatar | 266/82 |
| 4,395,166 | 7/1983 | Ulveling | 266/81 |

*Primary Examiner*—L. Dewayne Rutledge
*Assistant Examiner*—S. Kastler
*Attorney, Agent, or Firm*—Balogh, Osann, Kramer, Dvorak, Genova & Traub

[57] ABSTRACT

Disclosed herein is an apparatus for blowing a powdery refining agent into a refining vessel which is adapted to blow the powder into a molten metal bath of the refining vessel together with a refining gas by feeding the powder from a pressure vessel to a main pipe for the supply of the refining gas. The pressure vessel is connected to the main pipe through a plurality of transportation pipes each provided with an on-off valve and connected to a secondary gas pipe for introduction of the refining gas downstream of the on-off valve. The secondary gas pipe is provided with a flow control valve.

3 Claims, 3 Drawing Figures

APPARATUS FOR BLOWING POWDERY REFINING AGENT INTO REFINING VESSEL

This application is a continuation, of application Ser. No. 563,448, filed Dec. 20, 1983 now abandoned.

This invention relates to an apparatus for blowing a powdery refining agent into a refining vessel and the like, and more particularly to an improvement in the technic for controlling an amount of the powdery refining agent blown when the powder is blown into a molten metal bath of a bottom-blown or top- and bottom-blown refining vessel or the like through tuyeres together with a refining gas.

In the bottom-blown refining vessel, top- and bottom-blown refining vessel, RH type vacuum degassing apparatus, ladle or the like, the refining of molten metal is carried out by blowing a refining gas through tuyeres arranged in the molten metal bath. In such a blowing of the refining gas, a powdery refining agent such as quicklime or the like is usually included in the refining gas. In this case, while an inside of a pressure vessel storing the powder is pressurized by using the refining gas, the powder is discharged at a constant rate from the pressure vessel and fed to a main pipe for the supply of the same refining gas.

In order to discharge the powder at a constant rate from the pressure vessel, there have conventionally been adopted a method of controlling the discharge amount by a mechanical way such as adjustment of an opening degree of a rotary valve or the like, or a method of controlling a pressure of the pressure vessel to control the discharge amount, and the like. However, in the latter method, it is difficult to maintain a terminal portion of a powder transportation pipe at substantially a constant pressure. Further, in order to maintain the terminal portion at a desired pressure, the volume of the pressure vessel must be increased, which results in the lowering of the response on the control of the discharge amount. Accordingly, the former mechanical way has usually been adopted.

The conventional mechanically powder-discharging apparatus will be described below with reference to FIG. 1.

Referring to FIG. 1, a powdery refining agent stored in a pressure vessel 1 is weighed through a metering valve 2 and fed to a main pipe 3 for the supply of a refining gas, which is blown into a molten metal bath of a converter or the like together with the refining gas. As the metering valve 2 for controlling the amount of the powder to be blown, there may be used a large special valve employing a V-notched ball 4 or the like. On the other hand, an amount of the refining gas (for example, oxygen gas) to be blown into a refining vessel such as a converter or the like is controlled by a flow control valve 5 arranged in the main pipe 3. The opening degree of the flow control valve 5 is controlled by a feedback signal fed from a flow meter 6 and a flow control meter 7.

The inside of the pressure vessel 1 is pressurized by supplying a part of the refining gas bifurcated from the main pipe 3. In this case, although it is considered to control the blowing amount of the powder by varying the pressure of the pressure vessel 1, the response to pressure change is poor because the volume of the pressure vessel 1 is large, so that the pressure of the pressure vessel 1 is maintained at a constant pressure $P_1$ by means of a pressure control valve 8 disposed in a pressure supply line. In this way, the fluidization of the powder within the pressure vessel 1 is promoted by supplying the refining gas to the pressure vessel 1.

Further, a part of the refining gas is supplied from the main pipe 3 through a valve 9 to the metering valve 2, so that the fluidization of the powder may be also promoted in the metering valve 2.

With the above arrangement, the opening degree of the metering valve 2 is controlled by rotating the V-notched ball 4, whereby the amount of the powder to be supplied to the main pipe 3 is controlled.

In FIG. 1, a reference numeral 10 is a load cell for detecting the remaining amount of the powder in the pressure vessel 1, and a reference numeral 11 is a flexible tube.

In the conventional method of controlling the blowing amount of the powder as illustrated in FIG. 1, since the mechanical metering means such as V-notched ball 4 or the like is used as the metering valve 2, there are some drawbacks that the seal portion sliding in the powder-containing atmosphere wears out vigorously, which leads to poor sealing for the refining gas and violent change in the powder discharge amount with time, and causes complications in the maintenance. Further, since a large special valve using the V-notched ball or the like is used as the metering valve 2, the means for controlling the discharge amount of the powder is extremely expensive.

It is, therefore, an object of the invention to eliminate the aforementioned drawbacks of the prior art and to provide an apparatus for blowing a powdery refining agent which can cheaply be manufactured in a simple structure without causing the change in the discharge amount with time due to the wearing and the like and using a special valve, and is simple in the maintenance, and assuredly and systematically permits the control of the powder discharge amount.

An essential feature of the invention lies in that the transportation of the powdery refining agent from the pressure vessel to the main pipe for the supply of the refining gas is carried out by plural transportation pipes and at the same time a secondary gas pipe is connected to each of the transportation pipes; and the discharge and transportation amount of the powder is adjusted by controlling the opening and closing of the transportation pipe and the flow rate of gas in the secondary gas pipe.

That is, according to the invention, there is the provision of an apparatus for blowing a powdery refining agent into a refining vessel by feeding the powder from a pressure vessel pressurized with a refining gas to a main pipe for the supply of the refining gas and blowing it into a molten metal bath of the refining vessel together with the refining gas, which includes a plurality of transportation pipes connecting the pressure vessel to the main pipe, an on-off valve arranged in each of the transportation pipes, a plurality of secondary gas pipes for the introduction of the refining gas connected to the transportation pipes downstream of the on-off valves, respectively, and a flow control valve arranged in each of the secondary gas pipes, whereby a discharge and transportation amount of the powder is adjusted by controlling the opening and closing of each of the on-off valves and the opening degree of each of flow control valves.

In the preferred embodiment of the invention, plural pipes having different diameters are used as the transportation pipe, from which an appropriate pipe may be selected in accordance with the required discharge and transportation amount.

Further, it is preferable that a throttle portion is arranged in the vicinity of each of the transportation pipes so as to reduce the fluctuation of the refining gas and powdery refining agent flowing through the transportation pipe against the change of flow rate in the secondary gas pipes, whereby the transportation amount of the powder from the pressure vessel may easily be adjusted.

The invention will be described in more detail with reference to the accompanying drawings wherein.

Figure 2:
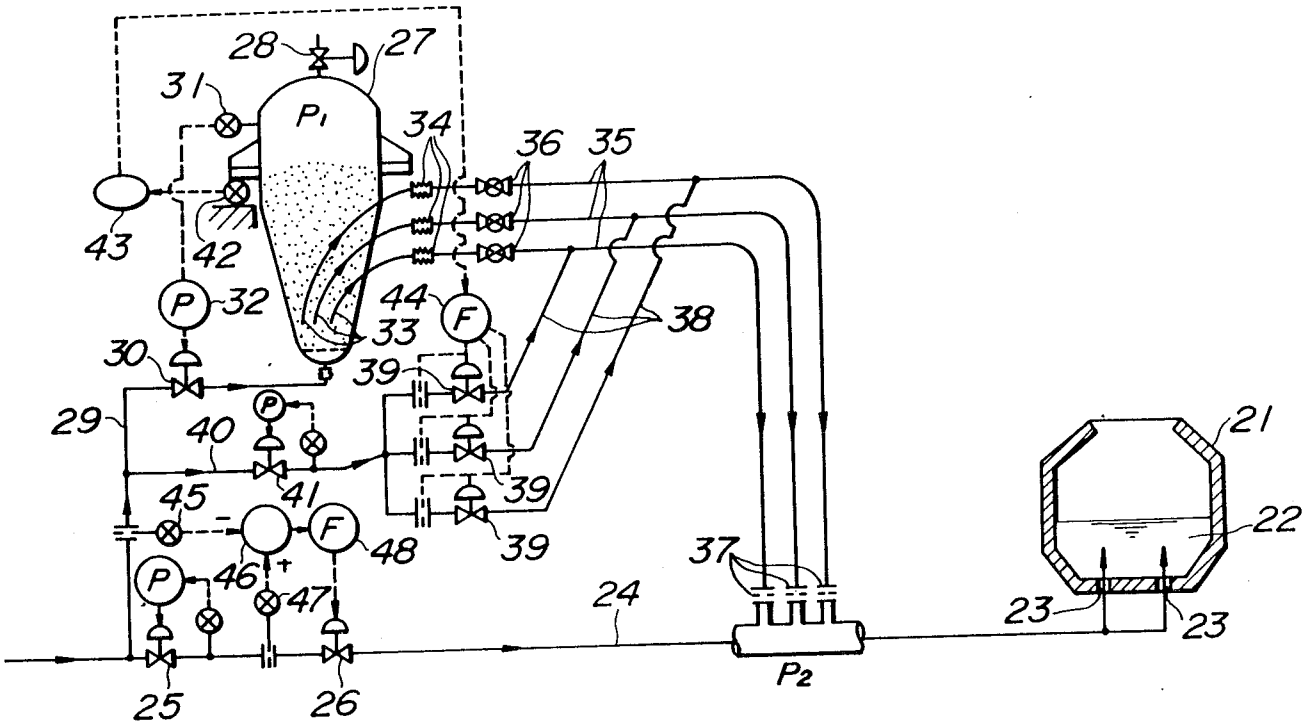
FIG. 2 is a schematic view illustrating an embodiment of the apparatus for blowing the powdering refining agent into the refining vessel according to the invention.

FIG. 2 shows substantially the whole construction of the apparatus according to the invention, in which a refining gas (for instance, oxygen gas) is blown into a molten metal bath 22 in a bottom-blown converter 21 through tuyeres 23 from a main pipe 24 for the supply of refining gas. In the main pipe 24 are arranged a pressure control valve 25 and a flow control valve 26, which control the pressure and flow rate of the refining gas supplied from a refining gas source (not shown) before the blowing into the molten metal bath 22. A reference numeral 27 is a pressure vessel, to which a powdery refining agent (for instance, quicklime, etc.) is supplied through a powder supply inlet 28.

To the bottom portion of the pressure vessel 27 is connected a pressurizing line 29, through which the pressure of the refining gas upstream of the pressure control valve 25 in the main pipe 24 is applied to the pressure vessel 27. In the pressurizing line 29 is arranged a pressure control valve 30 which is adapted to maintain the pressure in the pressure vessel 27 at a constant pressure $P_1$ during the discharge of the powder. The pressure control valve 30 is controlled by means of a pressure gauge 31 for detecting the pressure in the pressure vessel and a pressure controller 32.

In the pressure vessel 27 are disposed a plurality of powder discharge nozzles 33 (in the illustrated embodiment, three powder discharge nozzles) each being connected to the respective one of plural powder transportation pipes 35 (in the figure, similarly three pipes) through each of flexible hoses 34. Each of the transportation pipes 35 is provided with an on-off valve 36 and connected at its outlet to the main pipe 24 downstream of the flow control valve 26.

Further, a throttle portion (orifice) is arranged in the vicinity of the outlet of each transportation pipe 35, i.e., the vicinity of each joint portion between the transportation pipe 35 and the main pipe 24. In such a manner, the powder stored in the pressure vessel 27 is transported through each of the transportation pipes and fed into the refining gas flowing through the main pipe 24.

To each of the transportation pipes 35 is connected a secondary gas pipe 38 downstream of the corresponding on-off valve 36. In turn, the secondary gas pipe 38 is provided with a flow control valve 39. Thus, the refining gas is introduced into each of the secondary gas pipes 38 through a secondary gas line 40 from the upstream of the main pipe 24. In the secondary gas line 40 is arranged a pressure control valve 41.

Each of the flow control valves 39 functions to control the transportation amount of the powder in the respective transportation pipe 35. On the other hand, a load cell 42 is provided in the pressure vessel 27. The opening degree of each flow control valve 39 is controlled by output signals from a flow controller 44 after the weight (dw/dt) of after the from the pressure vessel is detected by means of a flow indicator 43 connected to the load cell 42 and the detected value is fed to the flow controller 44. Thus, the amount of the powder passing through each of the transportation pipes 35 is controlled to the desired discharge value by controlling each of the flow control valves 39 on the basis of weight of the discharged powder.

Since the difference between the pressure $P_1$ inside the pressure vessel 27 and the pressure $P_2$ at the joint portion of the main pipe 24 is substantially constant, the whole amount of the refining gas flowing through each transportation pipe 35 becomes also constant. Therefore, when the refining gas is supplied to the inside of the transportation pipe 35 through the secondary gas pipe 38, the amount of the refining gas supplied from the pressure vessel 27 changes downstream of the joint portion between the transportation pipe 35 and the secondary gas pipe 38, whereby the discharge amount of the powder supplied from the pressure vessel 27 is controlled.

The total flow amount of the refining gas into the pressurizing line 29 and the secondary gas line 40 is detected by means of a flow meter 45, from which the detected signal is outputed to a corrector 46. On the other hand, the flow amount of the refining gas in the main pipe 24 is detected by means of a flow meter 47, from which the detected signal is outputed to the corrector 46. Then, a correcting signal is outputed from the corrector 46 to a flow control meter 48. Thus, the opening degree of the flow control valve 26 is controlled by an output signal from the flow control meter 48 in such a manner that the total amount of the refining gas flowing through the main pipe 24 and the transportation pipe 35 corresponds to the desired amount of the refining gas to be blown into the molten metal bath 22.

The orifice 37 arranged in the vicinity of the outlet of each of the transportation pipes 35 serves to reduce the fluctuation of the refining gas and powdery refining agent flowing through the transportation pipe against the change of the flow amount of the refining gas in the secondary gas pipe 38, whereby the transportation amount of the powder from the pressure vessel 27 may be adjusted easily and accurately.

Transportation pipes 35 may have different diameters. In this case, a pipe to be used or a transportation pipe opening an on-off valve 36 may be selected from such plural pipe in accordance with the desired discharge and transportation amount of the powder.

The operation for controlling the discharge amount of the powdery refining agent in the apparatus shown in FIG. 2 is carried out as follows.

At first, the pressure $P_1$ within the pressure vessel 27 is kept constant during the ordinary discharge operation. Therefore, if the amount of the refining gas and the amount of the powder to be blown into the bottom-blown converter 21 are set, the pressure $P_2$ at the joint portion between the main pipe 24 and the transportation pipes 35 is determined naturally.

Under these conditions, while the refining gas (oxygen gas or the like) is flowed through the main pipe 24 to start the refining, the on-off valves 36 are controlled to set the discharge and transportation amount of the powder to a desired value on the basis of the powder blowing order.

Now, assume that the desired value is attained by opening all of the plural on-off valves 36 (three valves in this embodiment). If it is intended to reduce the discharge amount of the powder from the opened state of all valves 36 during the refining, the opening degree of one of the flow control valves 39 (two or three as the case may be) arranged in the secondary gas pipes 38 is increased to make the flow rate large, whereby the flow amount of the refining gas increases in the respective transportation pipe 35 corresponding to the secondary gas supply pipe. As a result, since the pressure difference $P_1$–$P_2$ between the inlet and outlet of each transportation pipe 35 is kept substantially constant, the amount of the powder flowing downstream the on-off valve 36 in the respective transportation pipe 35 is reduced. In other words, since the total amount of the refining gas and the powdery refining agent flowing through the transportation pipe 35 is invariable during the blowing, when the amount of the refining gas flowing downstream the on-off valve 36 is increased by supplying the refining gas from the secondary gas pipe 38, the amount of the powder passing through the transportation pipe 35 naturally decreases, so that the discharge and transportation amount of the powder can be reduced by the decreased amount of the powder flowing downstream the valve 36. On the other hand, if it is intended to increase the discharge amount of the powder, it is sufficient to perform the control reverse to the above. Thus, the blowing amount of the powdery refining agent into the refining vessel or the like can be controlled.

In order to further decrease the blowing amount of the powdery refining agent, the following control is made: that is, the on-off valve 36 used for decreasing the amount of the powder as mentioned above is closed before the amount of the powder passing through this valve 36 reaches a lower control limit for the supply of the powder in the respective transportation pipe 35, while the powder is transported by means of the other two transportation pipes 35. In the same manner as described above, it is possible to decrease the flow amount of the powder up to the minimum value.

Figure 1:
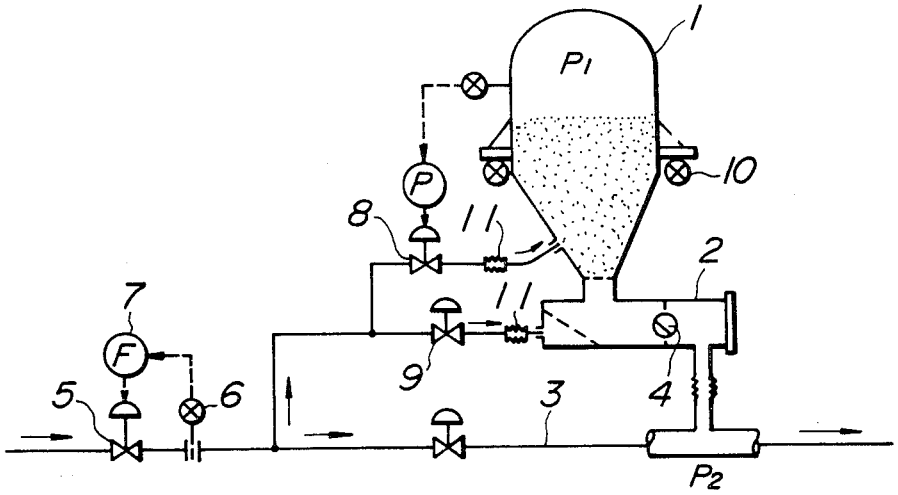
FIG. 1 PRIOR ART
FIG. 1 is a schematic view illustrating the conventional apparatus for controlling the discharge and transportation amount of the powder discharged powdery refining agent when the powder is blown into the refining vessel.

Therefore, the controllable minimum value of the powder to be flown in the apparatus of FIG. 2 is equal to the lower control limit for the powder in the last one transportation pipe 35. If it is required to further decrease the amount of the powder blown over the lower control limit, the diameter of the last transportation pipe 35 and the size of the on-off valve 36 arranged in this pipe are sufficient to be made smaller than these of the other pipes and valves. Thus, it is possible to realize a far larger control range on the flow amount of the powder by making the sizes of the transportation pipes and the on-off valves 36 different from one another, as compared with that attainable by one valve (for instance, metering valve in FIG. 1), whereby it is possible to freely control the discharge and transportation amount of the powder over an extremely wide range. Accordingly, with the use of the plural transportation pipes 35 having different diameters, it is possible to control the transportation amount of the powder promptly and accurately by selectively employing an appropriate transportation pipe or pipes in accordance with the required transportation amount range.

Further, it is also possible to control the blowing amount of the powder by properly selecting the diameter of the throttle portion 37 arranged in the outlet of the corresponding transportation pipe 35. In addition, since the arrangement of the throttle portion 37 can reduce the fluctuation of the refining gas and powdery refining agent flowing through the transportation pipe against the change of flow rate in the secondary gas pipes 38, the invention has the advantage that the transportation amount of the powder can be controlled with ease and accuracy.

Figure 3:
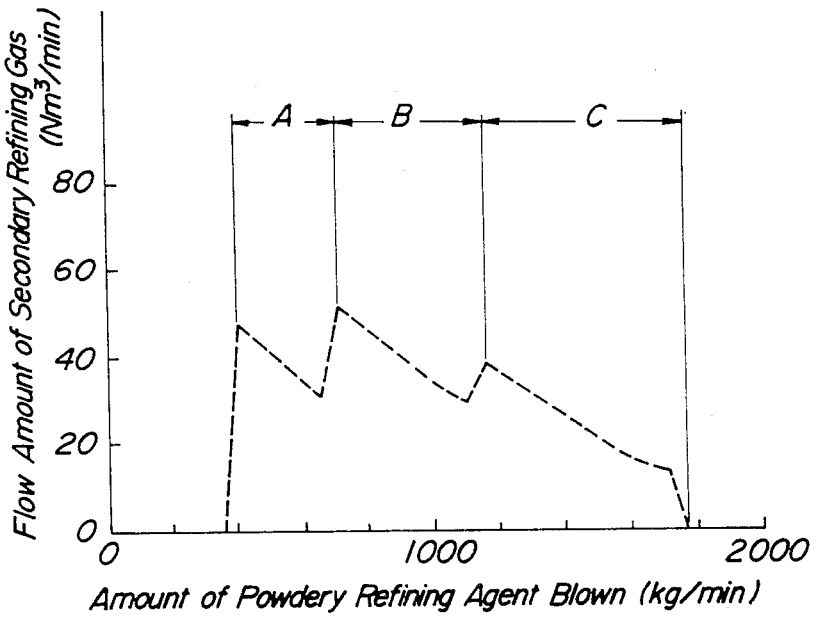
FIG. 3 is a graph illustrating test results when the apparatus shown in FIG. 2 is applied to the top- and bottom-blown converter.

FIG. 3 is a graph illustrating a test result when the apparatus shown in FIG. 2 is applied to a top- and bottom-blown converter of 250 ton capacity equipped at its bottom with ten tuyeres, wherein an ordinate represents an amount of the refining gas flowing through the secondary gas pipes 38 and an abscissa represents an amount of the powdery refining agent flowing through the transportation pipes 35. In FIG. 3, the range A is the case of using a single transportation pipe 35, the range B is the case of using two transportation pipes and the range C is the case of using three transportation pipes.

In the test of FIG. 3, the pressure within the pressure vessel was kept constant at 13 $Kg/cm^2G$, while a pipe having a designation 65 A was employed as each of three transportation pipes 35, and an orifice of 25 mm in diameter was arranged in the outlet of each of the transportation pipes to form a throttle portion 37.

As understood from the test result of FIG. 3, the transportation amount of the powder cannot stably be controlled at a lower flow range of the refining gas supplied from the secondary gas pipes 38, but the control on the amount of the powder blown can accurately be performed at an extremely stable state when the flow amount of the refining gas in the secondary gas pipe is within a range of 15–60 $Nm^3/min$.

Although the stable control cannot be made at the low flow range in the test of FIG. 3 because three pipes having a designation of 65 A were employed as the transportation pipe, it is possible to stably control the amount of the powder blown even at the low blowing rate by reducing the diameters of the transportation pipes.

According to the above embodiment, the plural transportation pipes for the powdery refining agent are used and provided with on-off valves of two-way structure, respectively, so that it is possible to eliminate the defects of the conventionally used flow control valve which is difficult to accurately control the transportation amount of the powder at a high flow rate, and it is also possible to overcome the slide-wearing problems in the seal portion of the flow control valve. Therefore, according to the invention, it is possible to provide an apparatus for blowing the powdery refining agent into the refining vessel at cheap cost without causing the change in the amount of the powder blown due to the wearing of the valve and the increase of the manufacturing cost due to the use of any special valve as conventionally used. Moreover, since there comes into no problems with reference to the wearing of the valve and the use of any special valve, the maintenance and inspection of the apparatus become extremely simplified.

As mentioned above, according to the invention, a plurality of transportation pipes for the powdery refining gas are used, while a secondary gas (refining gas) is independently introduced into each of the transportation pipes, so that the discharge and transportation amount of the powder is controlled by controlling the opening and closing of each transportation pipe and the amount of the refining gas supplied from the secondary gas pipe. As a result, there is no variation in the transportation amount of the powder with the lapse of time, and the control of the transportation amount can be performed over a wider range.

What is claimed is:

1. An apparatus for blowing a powdery refining agent into a refining vessel by feeding the powder from a pressure vessel pressurized with a refining gas to a main pipe for the supply of the refining gas and blowing it into a molten metal bath of the refining vessel which comprises a plurality of transportation pipes directly connecting said pressure vessel to said main pipe, an on-off valve arranged in each of said transportation pipes, a plurality of secondary gas pipes for the introduction of the refining gas supplied by said main pipe, said plurality of secondary gas pipes being connected to said transportation pipes downstream of said on-off valves, respectively, a variable flow control valve arranged in each of said secondary gas pipes, and means responsive to rate of flow of powder discharged from said pressure vessel for adjusting each of said variable flow control valves to obtain desired gas-powder mixture flowing in said transportation pipes, whereby the rate of flow of the powder discharged from the pressure vessel is controlled only by the opening degree of each of said flow control valves.

2. The apparatus as claimed in claim 1, wherein said transportation pipes have different diameter.

3. The apparatus as claimed in claim 1, wherein a throttle portion is disposed in the vicinity of the outlet of each of said transportation pipes.

* * * * *